US007914117B2

(12) United States Patent
Tanuma

(10) Patent No.: US 7,914,117 B2
(45) Date of Patent: Mar. 29, 2011

(54) INKJET PRINTER AND INKJET HEAD

(75) Inventor: Chiaki Tanuma, Tokyo-To (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 760 days.

(21) Appl. No.: 11/768,719

(22) Filed: Jun. 26, 2007

(65) Prior Publication Data

US 2008/0024562 A1 Jan. 31, 2008

(30) Foreign Application Priority Data

Jun. 30, 2006 (JP) ..... 2006-181750

(51) Int. Cl.
*B41J 2/135* (2006.01)

(52) U.S. Cl. ..... 347/46

(58) Field of Classification Search ..... 347/44, 347/46, 68–72
See application file for complete search history.

(56) References Cited

U.S. PATENT DOCUMENTS 7,207,651 B2 * 4/2007 Amemiya ..... 347/46

FOREIGN PATENT DOCUMENTS

| | | |
|---|---|---|
| JP | 56025465 | 3/1981 |
| JP | 56063466 | 5/1981 |
| JP | 01238950 | 9/1989 |
| JP | 200094665 | 4/2000 |
| JP | 2004-261998 | 9/2004 |

OTHER PUBLICATIONS

English translation of Japanese Office Action dated Apr. 15, 2008, in JP Patent Application No. 2006-181750.
English Abstract of JP S56-25465.
English Abstract of JP S56-63466.
English Abstract of JP H01-238950.
English Abstract of JP 2000-94665.
Partial English translation of Specification of JP Patent Application No. S54-100696; published as S56-25465.
Partial English translation of Specification of JP Patent Application No. S54-140848; published as S56-63466.
Partial English translation of Specification of JP Patent Application No. S63-66470; published as H01-238950.
Partial English translation of Specification of JP Patent Application No. H10-270107; published as 2000-94665.
Machine translation of JP Publication No. 2000-94665.
Machine translation of JP Publication No. 2004-261998.
English Translation of Office Action issued in Chinese Appl 200710112276.9 on May 26, 2010.
English Abstract of JP 2004-261998 published Sep. 24, 2004.

* cited by examiner

*Primary Examiner* — An H Do
(74) *Attorney, Agent, or Firm* — DLA Piper LLP US

(57) ABSTRACT

The invention provides an inkjet printer that gives an excellent print quality by accelerating the traveling speed of an ink droplet ejected from a nozzle of the inkjet head. The inkjet printer includes the inkjet head having a surface forming a nozzle and adapted to eject droplets from the nozzle, an ultrasound radiator mounted on both sides of the surface and adapted to radiate ultrasound in the direction of the ink droplets that have been ejected and imparting a pressure, in flight, to the ink droplets that have been ejected, and a recording medium conveying unit for moving a recording medium relative to the inkjet head.

18 Claims, 6 Drawing Sheets

$$R_E = (Z1 - Z2) / (Z1 + Z2)$$

Expression 1

$$\tau I = I t / I i$$

$$= \frac{4}{(\sqrt{Z_3/Z_1} + \sqrt{Z_1/Z_3})^2 \cos^2(2\pi l/\lambda_2) + (Z_2/\sqrt{Z_1 Z_3} + \sqrt{Z_1 Z_3/Z_2})^2 \sin^2(2\pi l/\lambda_2)}$$

Expression 2

$$\lambda_2 = C_2 / f_2$$

$$dn(f) = \sqrt{(F+n\lambda+\lambda/4)^2 - F^2}$$

$n = 0, 1, 2, \cdots$

Expression 3

$$dn(i) = \sqrt{(F+(2n-1)^2/2+\lambda/4)^2 - F^2}$$

$n = 1, 2, \cdots$

Expression 4

$\lambda$: Wavelength of ultrasound

F: Focal length

Table 1: Distance from a center of Fresnel band (mm)

| n | 0 | 1 | 2 | 3 | 4 |
|---|---|---|---|---|---|
| dn(f) | 2.07 | 2.82 | 3.45 | 4 | 4.51 |
| dn(i) | -- | 2.47 | 3.73 | 4.26 | 4.99 |

FIG. 11

INKJET PRINTER AND INKJET HEAD

BACKGROUND OF THE INVENTION

1. Field of the Invention

The present invention relates generally to an inkjet printer and inkjet head that perform printing by ejecting ink onto a recording medium. More particularly, the invention relates to a technique of accelerating a traveling speed of an ink droplet that is ejected.

2. Description of the Related Art

In recent years, inkjet printers that print on a recording medium prevail for personal use and business use. Inkjet heads equipped in such inkjet printers are generally classified into a continuous type and an on-demand type. The continuous type is one in which printing is performed such that, while ink droplet is continuously ejected from a nozzle of the inkjet head, the trajectory of the ink droplet in flight is controlled so as to cause only ink droplets required for printing to land on a recording medium according to the print signals. The on-demand type is one in which printing is performed causing an ink droplet to eject from a nozzle of the inkjet head and deposit on a recording medium at only a required time according to the print signal.

In such inkjet printers, to gain high print-quality, a high accuracy on landing positions of ink droplets onto a recording medium has been demanded.

The print quality is likely subject to a traveling speed of an ink droplet ejected from a nozzle. In normal driving operations carried out in inkjet printers equipped with an on-demand type inkjet head, an initial flight rate of an ink droplet ejected is in the order of some 10 meter/second. At this traveling speed, if a distance between the inkjet head and a recording medium exceeds several millimeters, the resulted print quality likely becomes degraded. This is because ink ejection at such a low speed makes the flight trajectory of the ink droplet unstable due to an air flow or other factors encountered in the course of the ink travel, resulting in irregular landing positioning of the ink droplets on the recording medium. To avoid this problem, the distance between the nozzles and a recording medium needs to be maintained within a predetermined limit. This narrows down the freedom of design of the inkjet printers. On the other hand, in the continuous type, the traveling speed of an inkjet droplet is greater than that of the on-demand type. However, because the distance between the nozzle and a recording medium cannot be shortened due to the structural restriction of this print head, the traveling distance of the ink droplets ejected from the nozzle becomes long, and thus, the landing positions of the ink droplets become irregular.

As one method for solving the above problems, for example, Japanese laid-open patent publication No. 2004-261998 discloses a structure, in which an ultrasound transducer 14 that imparts a vibration force in the direction of ejection of an ink droplet 51 to a print head 31, is provided so as to superimpose the vibration force of the above-mentioned ultrasound transducer 14 (horn 33) of a component in the same direction as the ink flying direction onto the ejection force for the ink droplet 51 ejected from a given nozzle of the print head 31 so that a velocity S2 by the vibration force is superimposed onto a velocity S1 by the ejection force of the ink droplet (Refer to FIG. 4 in the patent publication).

However, this method involves a problem that there needs a complicated control circuit for superimposing the vibration force in the direction of ejection of an ink droplet onto a body of the inkjet head at the same timing as the ink ejection.

SUMMARY OF THE INVENTION

The present invention was made in view of the above problems. An object of the invention is to provide an inkjet printer and inkjet head capable of securing desired print quality by accelerating a traveling speed of an ink droplet even where a distance between a nozzle and a recording medium is increased.

One embodiment according to the present invention provides an inkjet printer comprising an inkjet head ejecting an ink droplet from a nozzle, an ultrasound radiator that radiates an ultrasound in the ejection direction of the ink droplet, a recording-medium conveying unit, wherein the recording-medium conveying unit moves the inkjet head and the recording medium relatively to each other, and the ultrasound radiator imparts a pressure by the ultrasound to the ink droplet that has been ejected so as to cause the ink droplet to land on the recording medium.

BRIEF DESCRIPTION OF THE DRAWINGS

These and other objects and advantages of this invention will become apparent and more readily appreciated from the following detailed description of the presently preferred exemplary embodiments of the invention taken in conjunction with the accompanying drawings, wherein:

FIG. 11 shows a specification of a Fresnel lens.

DETAILED DESCRIPTION OF THE INVENTION

Figure 1:
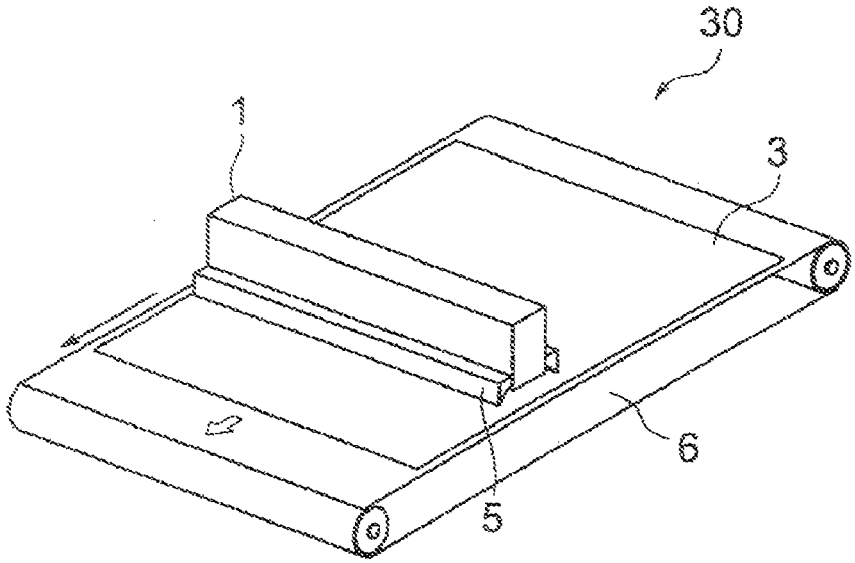
FIG. 1 is a diagrammatical view of an inkjet printer according to the present invention.

The present invention will now be described in more detail with reference to the accompanying drawings. However, the same numerals are applied to the similar elements in the drawings, and therefore, the detailed descriptions thereof are not repeated.

Hereinafter, there will be described an embodiment of an inkjet printer according to the present invention in reference to FIGS. 1-5. In this embodiment, the printer is equipped with a so-called on-demand type inkjet head.

Figure 2:
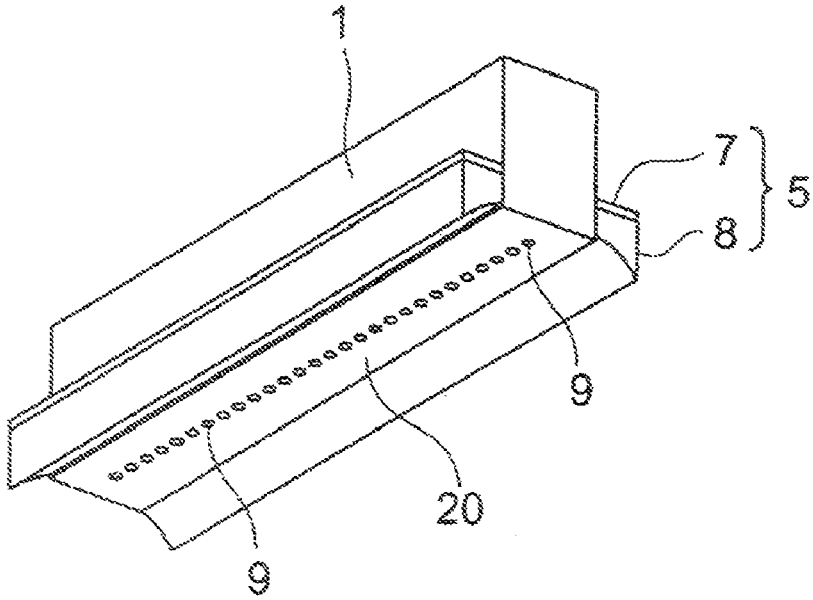
FIG. 2 is a perspective view of an inkjet head with an ultrasound radiator mounted therein according to the present invention.

FIG. 1 is a diagrammatical view showing a principle structure of an inkjet printer 30 according to the present invention. FIG. 2 is a perspective view of an inkjet head 1 installed in this inkjet printer 30. A recording medium 3 is conveyed relatively to inkjet head 1 by a recording-medium conveying unit 6, and ink droplets ejected from a nozzle 9 of inkjet head 1 are landed on recording medium 3 so that printing is performed. An ultrasound radiator 5 is mounted on the both sides of an end surface 20 in the longitudinal direction of inkjet head 1 where nozzles 9 are formed. Ultrasound radiator 5 is formed in a state that a matching member 8 is laminated over a piezoelectric vibrator 7. Although this matching member 8 may be formed in a plane, one in this embodiment is formed in a shape of a lens so as to converge an ultrasound on a given point in the flying direction of an ink droplet that has been ejected.

Figure 3:
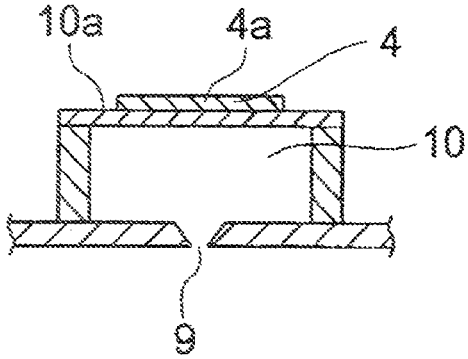
FIG. 3 is a partial cross sectional view of an ink chamber of an inkjet head within which an actuator is installed according to the present invention.

FIG. 3 shows a cross section of an ink chamber 10 of inkjet head 1. A piezoelectric element 4*a* as a pressure generator is disposed on an external surface of a flexible member 10*a*, which is provided on the surface that faces nozzles 9. These flexible member 10*a* and piezoelectric element 4*a* constitute an ink-ejecting actuator 4. When a drive signal for ejecting ink is applied to piezoelectric element 4*a*, the volume of ink within ink chamber 10 is caused to change by deformation of flexible member 10*a* so that an ink droplet is ejected from nozzle 9. In ink chamber 10 in this embodiment, nozzles 9 are arranged in line on end surface 20 of inkjet head 1. The number of nozzles and an interval between them are to be determined according to a printing mode, such as monochrome printing or color printing. Ink-ejecting actuator 4 is shown as in the case of using piezoelectric element 4*a*. However, a so-called bubble-jet type of a thermal inkjet method may be also applied thereto.

Figure 4:
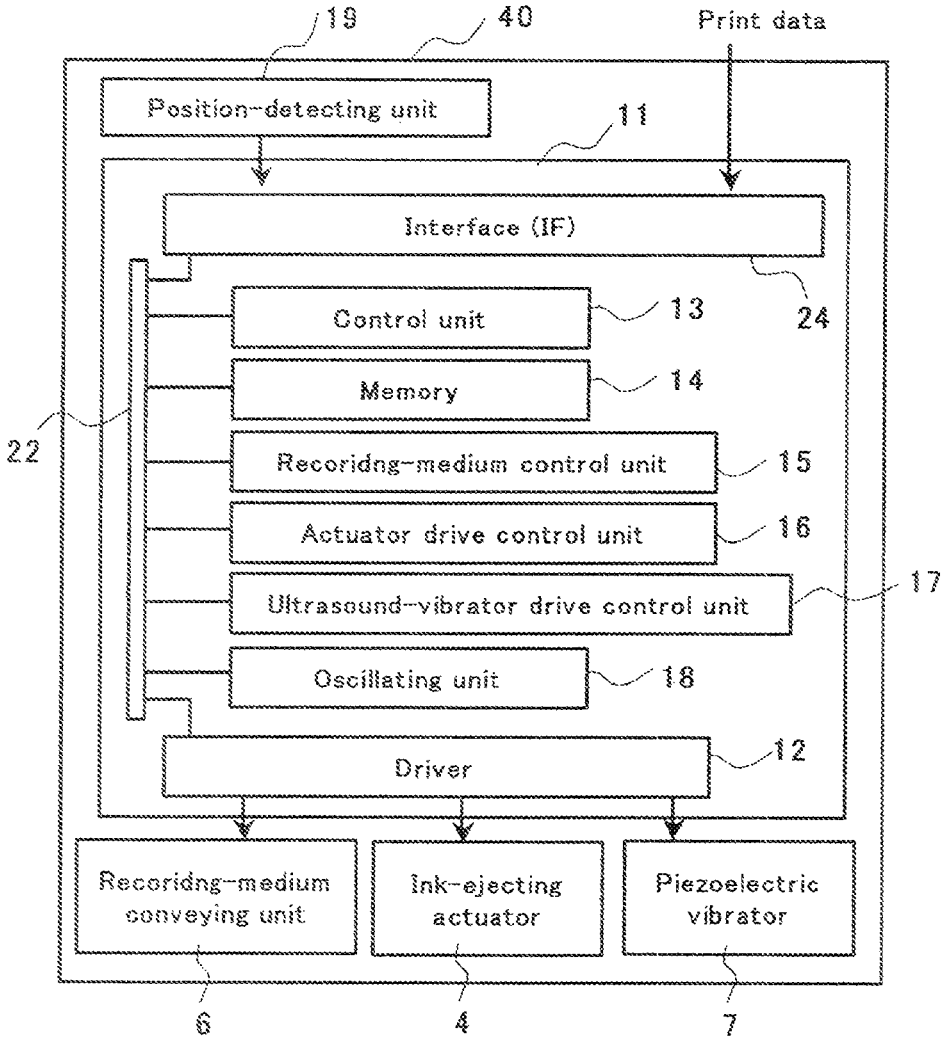
FIG. 4 is a block diagram of a control circuit of an inkjet printer according to the present invention.

Next, a control block 40, which causes inkjet printer 30 to operate to print, will be described in reference to FIG. 4. Control block 40 comprises a process control unit 11, ink-ejecting actuator 4, piezoelectric vibrator 7, recording-medium conveying unit 6, and position-detecting unit 19. Recording-medium conveying unit 6 controls operations of conveying recording medium 3 and moving inkjet head 1 and recording medium 3 relatively to each other in time with the timing of ejecting ink. The recording medium may be a continuous form, a sheet paper, or a film. Position-detecting unit 19 is used to detect or specify a printing position when a continuous form is used as recording medium 3. For this unit, for example, a transmission type photo-sensor or a rotary encoder, both commercially available, may be used. Process control unit 11 generates an ejection control signal for ejecting an ink droplet from a given nozzle 9 of inkjet head 1. This process control unit 11 also generates a vibration control signal that controls the driving of ultrasound radiator 5 to superimpose a pressure by an ultrasound in the same direction as the ink ejection force on an ink droplet that has been ejected at the timing of the ink ejection. Process control unit 11 comprises, as needed, control unit 13, bus 22, driver 12, interface (IF) 24, memory 14, recording-medium control unit 15, actuator drive control unit 16 for driving piezoelectric element 4*a* that ejects an ink droplet 2, ultrasound-vibrator drive control unit 17 for driving piezoelectric vibrator 7, and oscillating unit 18.

Control unit 13 integrally controls inkjet printer 30, and its control programs are stored in memory 14. Memory 14 also temporally stores print data that is input from, e.g. a host computer, and is used as a working area for control unit 13 or other units as needs arise. Driver 12 controls piezoelectric vibrator 7, ink-ejecting actuator 4, and recording-medium conveying unit 6, according to the respective units.

IF 24 interfaces with process control unit 11 when process control unit 11 receives print data from a host or other devices and signals from position-detecting unit 19. Recording-medium control unit 15 generates and sends drive control signals to recording-medium conveying unit 6 according to commands from control unit 13 based on print data. Actuator drive control unit 16 generates and sends ink-ejection control signals to ink-ejecting actuator 4 according to commands from control unit 13 based on print data. Ultrasound-vibrator drive control unit 17 generates and sends vibration control signals to piezoelectric vibrator 7 according to commands from control unit 13.

Oscillating unit 18 generates a clock pulse according to frequency settings by external and internal circuits, which becomes the bases of signals generated by actuator drive control unit 16 and ultrasound-vibrator drive control unit 17. In process control unit 11, oscillating unit 18 generates, by the single oscillating unit, basic clock pulses, based on which actuator drive control unit 16 and ultrasound-vibrator drive control unit 17 produce the ink-ejection control signals and vibration control signals, respectively. If the ink-ejection control signal and vibration control signal are in the relation wherein the two signals can be mutually synchronized in a desirable fashion, oscillating unit 18 need not be of a single unit.

First Embodiment

Figure 5:
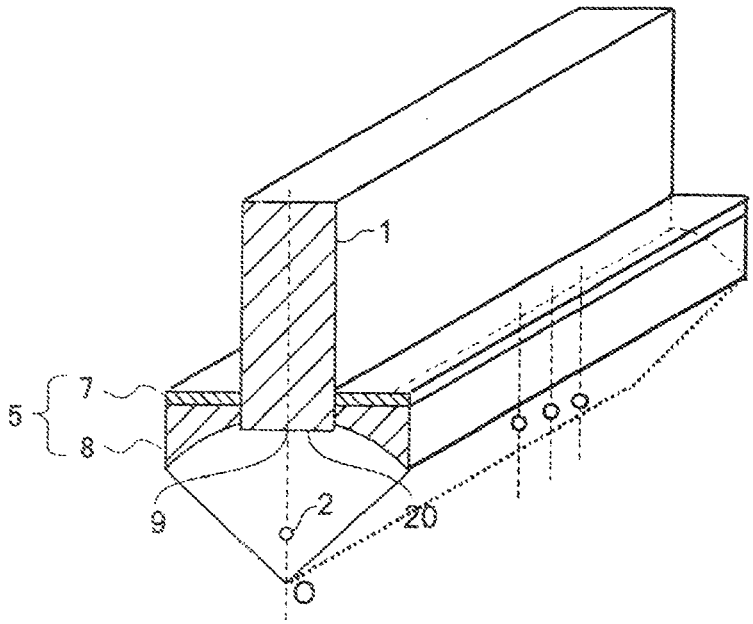
FIG. 5 is a partial cross sectional view of an inkjet head at a side of which an ultrasound radiator is installed.
Figure 6:
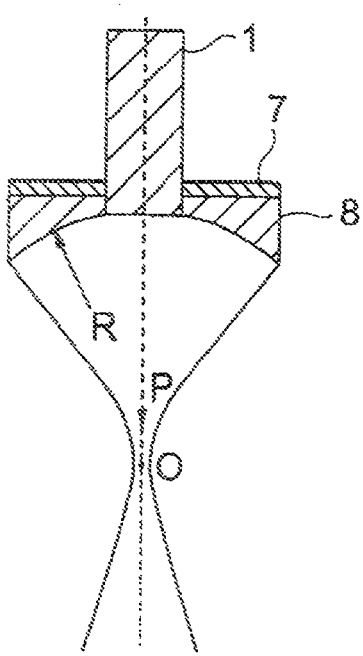
FIG. 6 is an illustration showing in principle how the pressure by the radiation of an ultrasound of the ultrasound radiator according to the present invention is imparted to an ink droplet.

An embodiment of ultrasound radiator 5 above-mentioned will be described below referring to FIGS. 5 and 6.

Ultrasound radiator 5 is comprised of piezoelectric vibrator 7 and matching member 8 that is laminated on the surface of this piezoelectric vibrator 7 in the direction to which an ink droplet is ejected. Piezoelectric vibrator 7 vibrates at a predetermined frequency that is based on the applied pulse of a frequency within the ultrasound bandwidth. Matching member 8 is formed in a concave so as to focus the ultrasound radiated by piezoelectric vibrator 7 at a point on the trajectory of flying ink droplet 2, composing a so-called an acoustic lens having a focus point of point O. The ultrasound radiated from piezoelectric vibrator 7 is focused at this point O on the trajectory of flying ink droplet 2 by matching member 8, and thereby a pressure P is produced in the vicinity of point O. Ink droplet 2 ejected from nozzle 9 flies by virtue of the ejection force toward focus point O of matching member 8. The pressure increases as the ink droplet approaches point O because the radiated ultrasound increasingly converges. Then, the ink droplet passes point O. At this time, as the ejection force of ink droplet 2 is boosted by received pressure P, its traveling speed is accelerated. By thus setting the focus point of matching member 8 composing an acoustic lens at an appropriate point on the trajectory of flying ink droplet 2, the traveling speed of ink droplet 2 that has been ejected from nozzle 9 can be accelerated. Focus point O is positioned at the center of a circle having a radius R, assuming that the curvature of the radiation surface of the matching member is R.

The ultrasound radiated from piezoelectric vibrator 7 increases its propagation loss if the difference between the specific acoustical impedance of piezoelectric vibrator 7 and the specific impedance of the air layer is large. To reduce this propagation loss, such a material is selected as matching member 8 that its specific acoustical impedance lies in the middle between those of piezoelectric vibrator 7 and the air layer.

Figure 7:
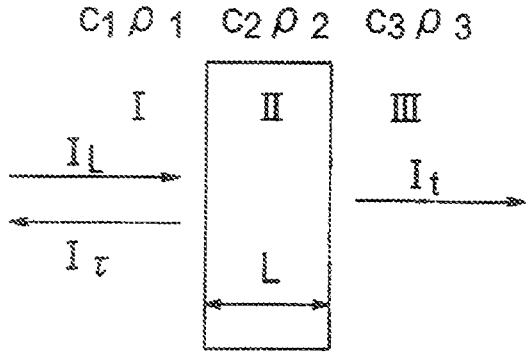
FIG. 7 is a diagram illustrating a physical property of a medium through which an ultrasound propagates.

As illustrated in FIG. 7, when arriving at the boundary between materials coming through one material and hitting a boundary between materials of the one and another having different specific acoustical impedances, the ultrasound in part transmits through the boundary while the other reflects on the boundary. A product of a density by an acoustic velocity of a material (density ρ by acoustic velocity v of a material) is generally termed as a "specific acoustical impedance" of the material. Now, assuming that an ultrasound arrives vertically at a boundary surface between two materials having specific acoustical impedances of Z1 and Z2, the amplitude reflectance Re then is given by expression 1 below. In this embodiment, medium I applies to piezoelectric vibrator 7; medium II applies to an acoustic lens 8; and medium III applies to the air layer.

A medium layer II having thickness L is interposed between medium I and medium III. Letting the respective sound velocities and densities of medium I, II, and III be $c_1$, $c_2$, $C_3$, $\rho_1$, $\rho_2$, and $\rho_3$, and assume that a sound wave having an intensity Ii has come in medium I, passes through medium layer II, and transmits medium III with a sound intensity It. By treating this case similarly to the case of incoming and transmitting of a sound wave on a plane boundary, the equation shown in FIG. 7 can be obtained.

Figure 8:
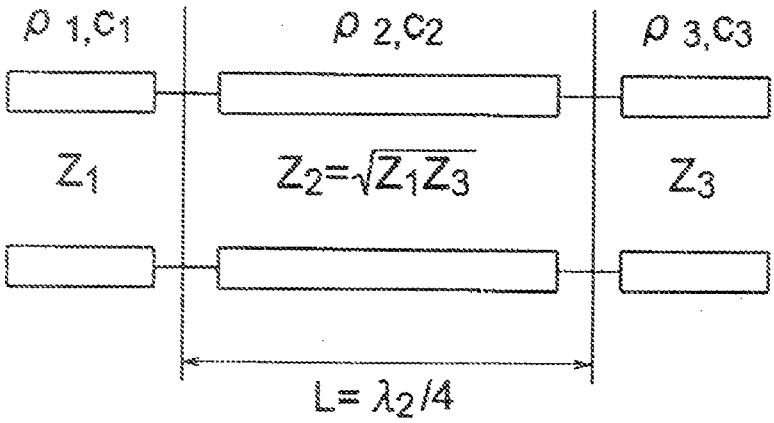
FIG. 8 shows the relationship between a physical property of a medium through which an ultrasound propagates and its specific acoustical impedance.

Referring to FIG. 8, if conditions of $L=\lambda_2/4$ and $Z_2=(Z_1Z_2)^{1/2}$ are met, $\tau I=It/It=1$ can be obtained and the incident wave transmits medium III with no loss (no reflection loss). In this embodiment, medium I corresponds to piezoelectric vibrator 7; medium II applies to matching member 8; and medium III applies to an air layer. As in the above case, if the thickness of matching member 8 $L=\mu_2/4$, and its specific acoustical impedance $Z_2=(Z_1Z_2)^{1/2}$, an ultrasound in-coming from piezoelectric vibrator 7 to matching member 8 ideally propagates in the air layer without any loss.

However, since a specific acoustical impedance is instinctive to a material, it is difficult to find a material as matching member 8 that can meet these conditions. As a material of matching member 8, if, at least, one having a specific acoustical impedance of a value in the middle between the specific acoustical impedance of piezoelectric vibrator 7 and the specific acoustical impedance of the air layer is selected, the propagation loss of the ultrasound can be reduced. As a preferable material for matching member 8, a resin, glass, ceramic, metal, etc. may be selected.

The above description has been made as in the case using piezoelectric vibrator 7 for ultrasound radiator 5. Other materials such as an electrostriction element or magnetostrictive element may also be used instead of the piezoelectric vibrator.

Second Embodiment

In embodiment 2, a description will be made when use is made of a Fresnel lens 8*b* as matching member 8 that composes an acoustic lens.

Figure 9:
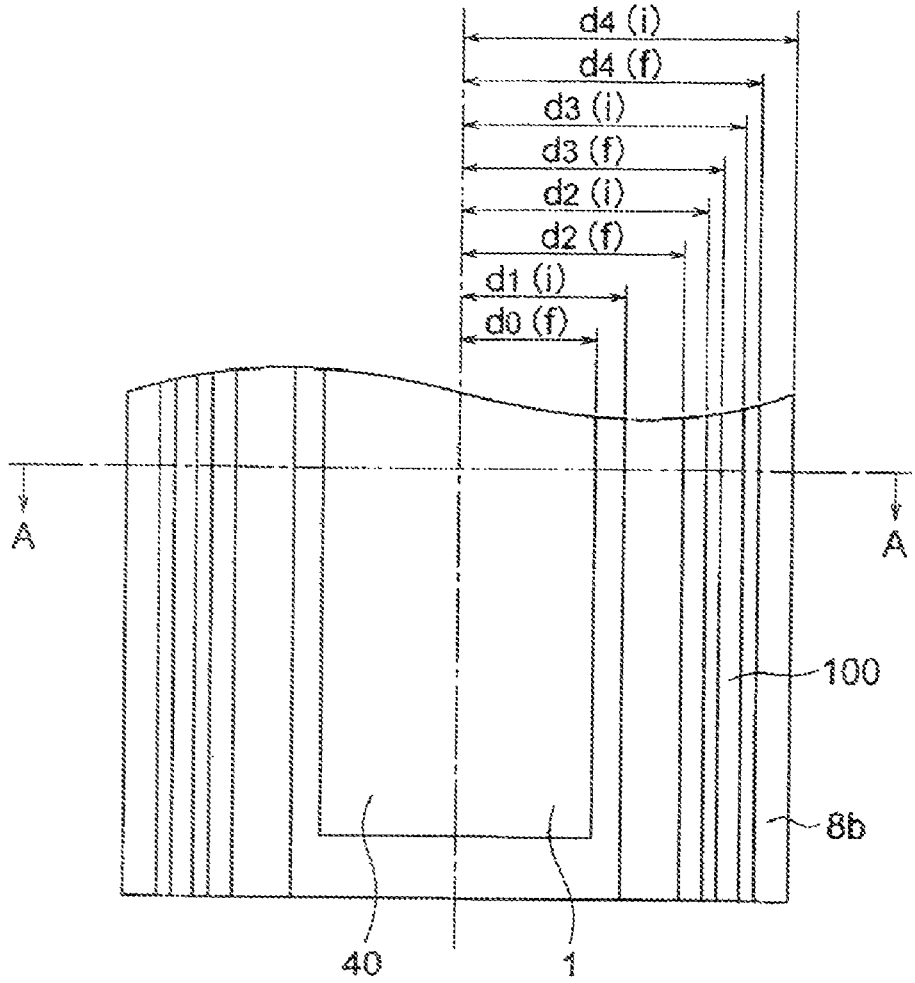
FIG. 9 is a top surface of a Fresnel lens according to the present invention.
Figure 10:
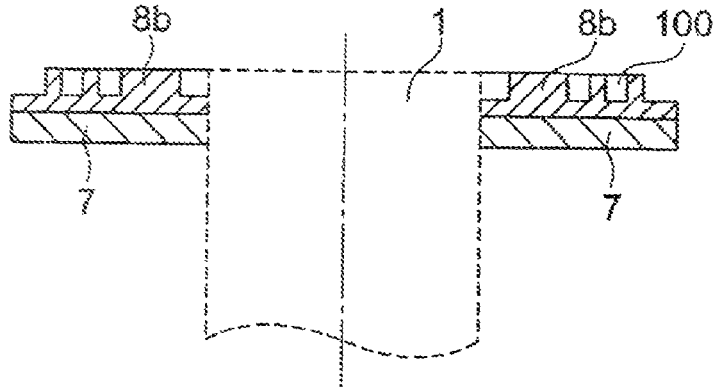
FIG. 10 is a cross sectional view taken on line A-A in FIG. 9.

Ultrasound radiator 5 comprises a laminated body formed of piezoelectric vibrator 7 and a lamination layer of Fresnel lens 8*b*. A top view of this Fresnel lens 8*b* is shown in FIG. 9, and a cross section taken on line A-A of FIG. 9 is shown in FIG. 10. In Fresnel lens 8*b*, grooves 100 are formed in a predetermined interval so that the ultrasound radiated from piezoelectric vibrator 7 can be focused on a given position in the ejection direction of droplet 2. Fresnel lens 8*b* is formed, for example, by machining an aluminum material. The groove of the Fresnel lens is calculated by the expressions shown in FIG. 11.

Now, descriptions will be made of one specific embodiment in which inkjet head 1 having a thickness 4 mm is installed in the middle part of a Fresnel lens. The middle part 40 of the Fresnel lens 8*b* was hollowed out. The end face 20 of inkjet head 1 was embedded in this hollowed-out part so that the end face 20 of inkjet head 1 was flatly aligned with the upper surface of Fresnel lens 8*b*. This Fresnel lens 8*b* was formed to a desired form by machining an aluminum material. Grooves 100 were formed in a rectangular aluminum material having width of 10 mm according to the dimensions given in Table 1, as illustrated in FIGS. 9 to 11.

The depth of each groove 100 was made to be 4.5 mm and the total thickness of Fresnel lens 8*b* was made to be 6 mm. By adequately determining the depths of the grooves 100 and the total thickness and appropriately selecting the specific acoustical impedance of the material that composes the acoustic lens, Fresnel lens 8*b* thus formed can provide the function as the matching member. That is, by setting the thickness of a remainder of the machining after subtracting the groove 100 from the total thickness of the acoustic lens to $\lambda_2/4$, the function as the matching layer can be accomplished.

Third Embodiment

Another embodiment of the present invention will be described below. In this embodiment, use was made of ultrasound radiator 5 comprising a laminated body consisting of a piezoelectric vibrator and matching member 8 in which an ultrasound is focused on a focus point of 1 mm apart from nozzle 9. The respective widths of the piezoelectric vibrator and matching member 8 were made to be 10 mm. This inkjet head 1 was disposed at the center in the width direction. This inkjet head 1 was mounted to the inkjet printer 30, and data spread of landing positions of ink droplets 2 on recording medium 3 was studied by varying the distance between nozzle 9 and recording medium 3 with or without operating ultrasound radiator 5.

As a result, when the distance between nozzle 9 and recording medium 3 exceeded 2 mm with ultrasound radiator 5 not operating, data of the landing positions appeared to spread. On the other hand, when ultrasound radiator 5 was operating, nearly the same data variation as in the distance between nozzle 9 and recording medium 3 of 1 mm was obtained. Even when the distance between nozzle 9 and recording medium 3 was further extended to 3 mm, the variation of the landing positions of ink droplets 2 did not enlarge.

In this way, even the distance between nozzle 9 and recording medium 3 was set relatively great, the variation of the landing positions of the ink droplets could be maintained low and degradation of the print quality could be prevented. In addition, since the distance between inkjet head 1 and recording medium 3 is allowed to be relatively large, the freedom degree of design of an inkjet printer can be enhanced.

The above ultrasound radiator 5 was exemplified as in the case wherein it was mounted integrally with the main body of the inkjet. However, ultrasound radiator 5 and the main body of the inkjet head may be separately formed and mounted to the main body of the printer.

The above embodiment has been described of an on-demand type inkjet printer. The invention can also be applied to a continuous type inkjet printer, which can perform the same effect.

According to the present invention, by superimposing the pressure by the ultrasound radiated from the ultrasound radiator on the ink droplet ejection force generated by the ink-ejection unit of the inkjet head, the traveling speed of ink droplets can be accelerated and variability of landing positions of ink droplet can be reduced even if the distance between the nozzle and the recording medium is extended. Thus, the degradation of print quality can be prevented.

The present invention has been described with respect to specific embodiments. However, other embodiments based on the principles of the present invention should be obvious to those of ordinary skill in the art. Such embodiments are intended to be covered by the claims.

What is claimed is:

1. An inkjet printer, comprising:

an inkjet head having a surface forming a nozzle, the inkjet head adapted to eject ink droplets from the nozzle;

an ultrasound radiator mounted on both sides of the surface, the ultrasound radiator adapted to radiate ultrasound in a direction of the ink droplets that have been ejected from the nozzle and imparting a pressure, in flight, to the ink droplets that have been ejected; and a recording medium conveying unit for conveying a recording medium relative to the inkjet head.

2. The inkjet printer according to claim 1, wherein said ultrasound radiator comprises a piezoelectric vibrator for radiating the ultrasound and a matching member laminated on the piezoelectric vibrator in the radiating direction of the ultrasound, the radiation direction of the ultrasound being along the direction of the ink droplets in flight that have been ejected.

3. The inkjet printer according to claim 2, wherein a specific acoustical impedance of the matching member is smaller than a specific acoustical impedance of the piezoelectric vibrator and greater than a specific acoustical impedance of air.

4. The inkjet printer according to claim 2, wherein the matching member is an acoustic lens for focusing the ultrasound at a given point on a trajectory of the inkjet droplet in flight.

5. The inkjet printer according to claim 4, wherein a surface of the acoustic lens from which the ultrasound is radiated is concavely formed.

6. The inkjet printer according to claim 4, wherein the acoustic lens is a Fresnel lens.

7. An inkjet head comprising:

an inkjet head main body having a surface forming a nozzle, the inkjet head main body adapted to eject ink droplets from the nozzle; and an ultrasound radiator mounted on both sides of the surface, the ultrasound radiator adapted to radiate ultrasound in a direction of the ink droplets that have been ejected and imparting a pressure, in flight, to the ink droplets that have been ejected from the nozzle.

8. The inkjet head according to claim 7, wherein said ultrasound radiator comprises a piezoelectric vibrator for radiating the ultrasound and a matching member laminated on the piezoelectric vibrator in the radiating direction of the ultrasound, the radiation direction of the ultrasound being along the direction of the ink droplets in flight that have been ejected.

9. The inkjet head according to claim 8, wherein a specific acoustical impedance of the matching member is smaller than a specific acoustical impedance of the piezoelectric vibrator and greater than a specific acoustical impedance of air.

10. The inkjet head according to claim 8, wherein the matching member is an acoustic lens for focusing the ultrasound at a predetermined point on a trajectory of the inkjet droplets in flight.

11. The inkjet head according to claim 10, wherein a surface of the acoustic lens from which the ultrasound is radiated is concavely formed.

12. The inkjet head according to claim 10, wherein the acoustic lens is a Fresnel lens.

13. A method of printing, comprising:

ejecting ink droplets from a nozzle provided in an inkjet head;

radiating an ultrasound in a direction of the ink droplets that have been ejected;

imparting a pressure generated by the ultrasound, in flight, to the ink droplets that have been ejected; and conveying a recording medium relatively to the inkjet head to deposit the ink drop thereon to form an ink image.

14. The method of printing according to claim 13, wherein the radiating includes generating the ultrasound with a piezoelectric vibrator and a matching member laminated on the piezoelectric vibrator in the radiating direction of the ultrasound.

15. The method of printing according to claim 14, wherein a specific acoustical impedance of the matching member material is smaller than a specific acoustical impedance of the piezoelectric vibrator and greater than a specific acoustical impedance of air.

16. The method of printing according to claim 14, wherein the matching member is an acoustic lens for focusing the ultrasound at a given point on a trajectory of the inkjet droplets in flight.

17. The method of printing according to claim 16, wherein a surface of the acoustic lens from which the ultrasound is radiated is concavely formed.

18. The method of printing according to claim 16, wherein the acoustic lens is a Fresnel lens.

* * * * *